US011515100B2

(12) United States Patent
Wang et al.

(10) Patent No.: US 11,515,100 B2
(45) Date of Patent: Nov. 29, 2022

(54) MODULAR BREAKING UNIT WITH A HOLDER-GUIDING ASSEMBLY AND CONTACTOR

(71) Applicant: Schneider Electric Industries SAS, Rueil-Malmaison (FR)

(72) Inventors: Yuanzhong Wang, Shanghai (CN); Jiaren Xiao, Shanghai (CN); Xuedong Xia, Shanghai (CN)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 17/377,782

(22) Filed: Jul. 16, 2021

(65) Prior Publication Data

US 2022/0020541 A1 Jan. 20, 2022

(30) Foreign Application Priority Data

Jul. 16, 2020 (CN) ..... 202010686206.X

(51) Int. Cl.
*H01H 1/14* (2006.01)
*H01H 9/02* (2006.01)

(52) U.S. Cl.
CPC ..... *H01H 1/14* (2013.01); *H01H 9/02* (2013.01)

(58) Field of Classification Search
CPC . H01H 1/14; H01H 9/02; H01H 50/54; H01R 4/48
USPC ..... 200/238; 439/816
See application file for complete search history.

(56) References Cited

U.S. PATENT DOCUMENTS

2012/0135646 A1* 5/2012 Johansson ..... H01H 50/546 439/816

FOREIGN PATENT DOCUMENTS

| | | | |
|---|---|---|---|
| CN | 210897140 | U | 6/2020 |
| CN | 210956485 | U | 7/2020 |
| DE | 3030702 | C2 | 8/1984 |
| FR | 2612686 | A3 | 9/1988 |
| FR | 2999790 | A1 | 6/2014 |
| WO | 2011015230 | A1 | 2/2011 |

OTHER PUBLICATIONS

Extended European Search Report dated Dec. 21, 2021 for corresponding European Patent Application No. 21305937.1-1202, 9 pages.

* cited by examiner

*Primary Examiner* — Renee S Luebke
*Assistant Examiner* — Iman Malakooti
(74) *Attorney, Agent, or Firm* — Locke Lord LLP

(57) ABSTRACT

A modular breaking unit with a holder-guiding assembly, wherein: the modular breaking unit includes a casing unit; a holder for holding a movable contact of the modular breaking unit is accommodated in the casing unit; the movable contact of the modular breaking unit is mounted on the movable contact holder; the holder-guiding assembly is installed in the casing unit and arranged to support and guide the movable contact holder to move between an open position and a closed position; the holder-guiding assembly is made of thermoplastic material; the movable contact holder is made of thermosetting plastic material. A contactor including at least one said modular breaking units.

9 Claims, 5 Drawing Sheets

MODULAR BREAKING UNIT WITH A HOLDER-GUIDING ASSEMBLY AND CONTACTOR

TECHNICAL FIELD

The present disclosure relates to a modular breaking unit with a holder-guiding assembly. The present disclosure also relates to a contactor comprising at least one said modular breaking units.

BACKGROUND

In the prior art, a casing of a breaking unit and a holder for a movable contact accommodated therein are both made of thermosetting materials. Friction will occur between them due to relative movement, and then pollution particles will be generated. The generation of pollution particles further aggravates the friction between the two, which hinders the moving performance of the moving contact, and long-term friction will lead to mismatch (gap) between silver tips of the moving contact and a fixed contact. In order to obtain good friction between them, it is necessary to form good guidance in shape and material between them.

SUMMARY

In order to solve one or more defects in the prior art, according to one aspect of the present disclosure, a modular breaking unit with a holder-guiding assembly is proposed, wherein the modular breaking unit comprises a casing unit.

A holder for holding a movable contact of the modular breaking unit is accommodated in the casing unit.

The movable contact of the modular breaking unit is mounted on the movable contact holder.

The holder-guiding assembly is installed in the casing unit and arranged to support and guide the movable contact holder to move between an open position and a closed position.

The holder-guiding assembly is made of thermoplastic material.

The movable contact holder is made of thermosetting plastic material.

According to some embodiments, the holder-guiding assembly includes a first guide and a second guide.

The first guide is disposed inside the casing unit and supports one end of the movable contact holder.

The second guide is disposed at an opening of the casing unit and supports the other end of the movable contact holder.

According to some embodiments, the first guide has a first guiding through hole.

The second guide has a second guiding through hole.

The movable contact holder passes through the first guiding through hole 1 and the second guiding through hole.

When the movable contact holder reciprocates between the open position and the closed position, an outer peripheral surface of the movable contact holder is in frictional contact with a first inner peripheral surface of the first guiding through hole and a second inner peripheral surface of the second guiding through hole, respectively.

According to some embodiments, the movable contact holder is provided with a movable contact holding through hole.

A holding spring is accommodated in the movable contact holding through hole.

One end of the holding spring abuts against an inner surface of the movable contact holding through hole.

The other end of the holding spring elastically presses the movable contact against the inner surface of the movable contact holding through hole.

Since the friction between the movable contact holder and the first guide as well as the second guide is the friction between thermosetting plastic materials, the self-lubricating function of thermoplastic plastic materials can be fully exerted, thus significantly reducing the friction between the movable contact holder and the first guide and the second guide, and further significantly reducing the generation of pollution particles.

According to the above configurations of the present disclosure, motion performance of the moving contact is greatly improved and the risk of mismatch (gap) between the silver tips between the moving contact and the fixed contact due to long-term friction is avoided.

According to some embodiments, an enhancing rib is provided on the outer peripheral surface of the first guide.

According to some embodiments, a fitting groove is provided on the outer peripheral surface of the second guide.

An edge of the opening of the casing is fitted in the fitting groove.

According to some embodiments, the first guide is an integrally formed single piece.

The second guide is an integrally formed single piece.

The movable contact holder is first assembled with the first guide and the second guide, and then assembled in the casing unit.

According to some embodiments, the first guide includes a first upper guide and a first lower guide which are formed separately.

The second guide includes a second upper guide and a second lower guide formed separately.

The first guiding through hole is formed when the first upper guide and the first lower guide are assembled together.

The second guiding through hole is formed when the second upper guide and the second lower guide are assembled together.

According to some embodiments, the casing unit includes an upper casing and a lower casing that can be fitted together.

The first upper guide and the second upper guide are integrally formed with the upper casing.

The first lower guide and the second lower guide are integrally formed with the lower casing.

According to the solutions disclosed by the invention, the complexity and cost of industrial assembly can be greatly simplified, whether the first guide and the second guide are integrally formed or separately formed.

According to some embodiments, a contactor is proposed that comprises at least one modular breaking unit as described above.

So far, in order that the detailed description of this disclosure can be better understood and the contribution of this disclosure to the prior art can be better recognized, this disclosure has summarized the content of this disclosure quite broadly. Of course, embodiments of the present disclosure will be described below and will form the subject matter of the appended claims.

Likewise, those skilled in the art will recognize that the concepts on which this disclosure is based can be easily used as a basis for designing other structures, methods and systems for carrying out several purposes of this disclosure. Therefore, it is important that the appended claims should be considered to include such equivalent structures as long as they do not go beyond the spirit and scope of the present disclosure.

BRIEF DESCRIPTION OF THE DRAWINGS

Those skilled in the art will have a better understanding of this disclosure through the following drawings, and the advantages of this disclosure can be more clearly reflected. The drawings described herein are only for illustrative purposes of selected embodiments instead of all possible implementations and are not intended to limit the scope of the present disclosure.

DETAILED DESCRIPTION

Hereinafter, specific embodiments according to the present disclosure will be described in detail with reference to various drawings.

Figure 1:
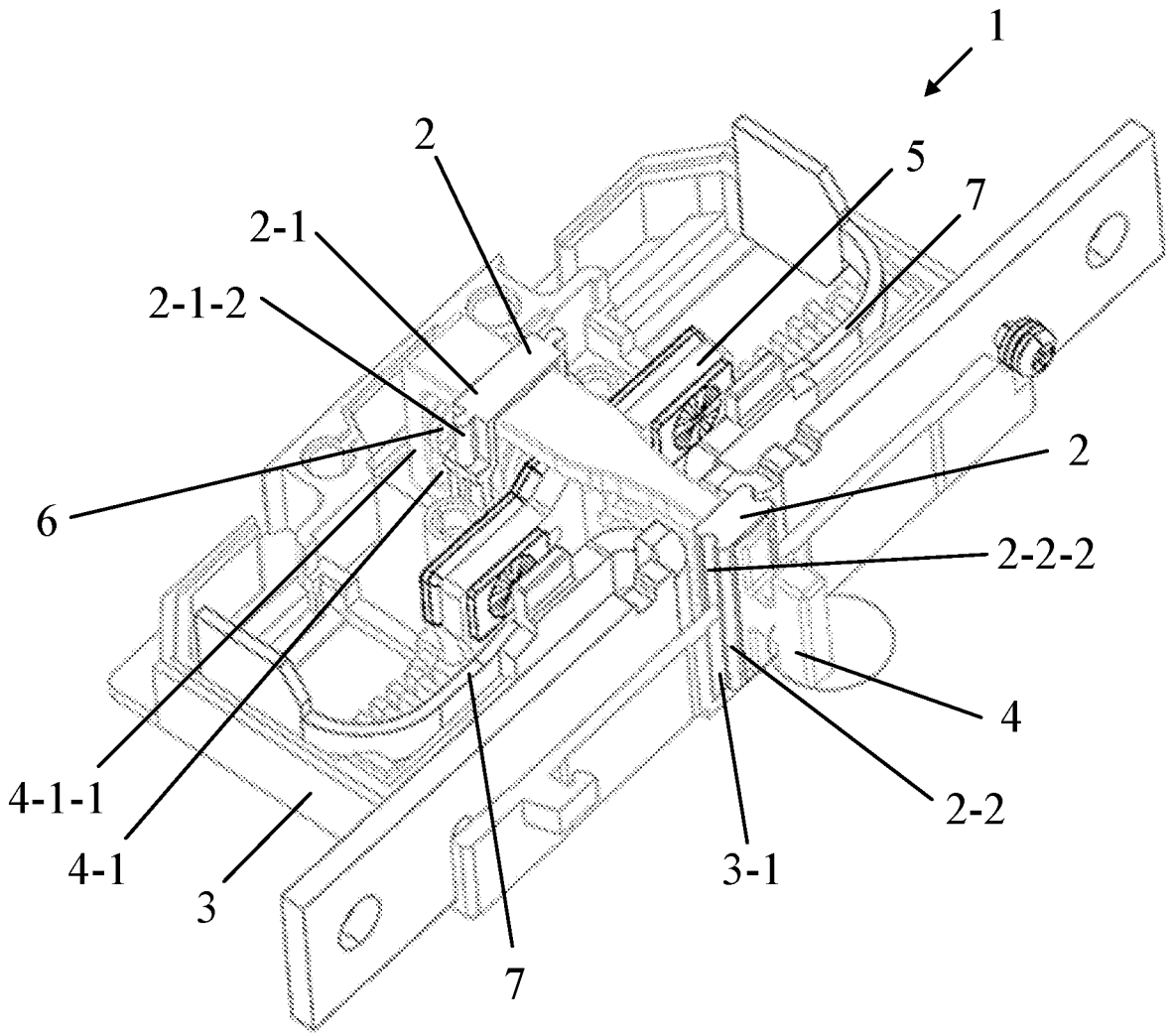
FIG. 1 shows the internal structure of a modular breaking unit according to the present disclosure.

According to one embodiment of the present disclosure, as shown in FIG. 1, a modular breaking unit 1 having a holder-guiding assembly 2 is proposed, wherein the modular breaking unit 1 includes a casing unit 3.

For the sake of clarity, FIG. 1 shows a fixed contact 7 and only the lower case of the casing unit 3.

A holder 4 for holding a movable contact of the modular breaking unit 1 is accommodated in the casing unit 3.

The movable contact 5 of the modular breaking unit 1 is mounted on the movable contact holder 4.

The holder-guiding assembly 2 is installed in the casing unit 3 and is configured to support and guide the movable contact holder 4 to move between an open position and a closed position, and then under the driving of the movable contact holder 4, the movable contact 5 installed thereon is separated from or contacted with the fixed contact 7.

The holder-guiding assembly 2 is made of thermoplastic material.

The movable contact holder 4 is made of thermosetting plastic material.

The materials of the holder-guiding assembly 2 and the movable contact holder 4 are selected so that they can withstand a temperature of at least 260 degrees Celsius.

According to the above embodiments of the present disclosure, the holder-guiding assembly 2 includes a first guide 2-1 and a second guide 2-2.

The first guide 2-1 is disposed inside the casing unit 3 and supports one end of the movable contact holder 4.

The second guide 2-2 is disposed at an opening 3-1 of the casing unit 3 and supports the other end of the movable contact holder 4. As shown in FIG. 1, a portion of the movable contact holder 4 protrudes from the opening 3-1.

Figure 2:
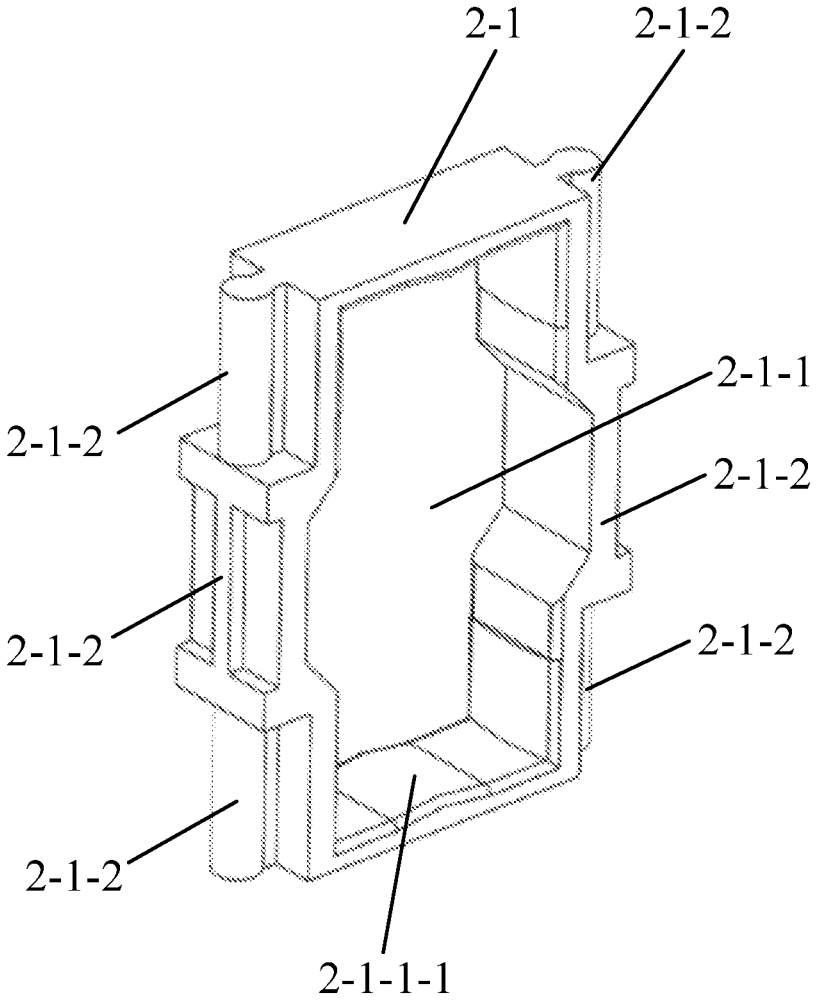
FIG. 2 shows an integrally formed first guide according to the present disclosure.
Figure 3:
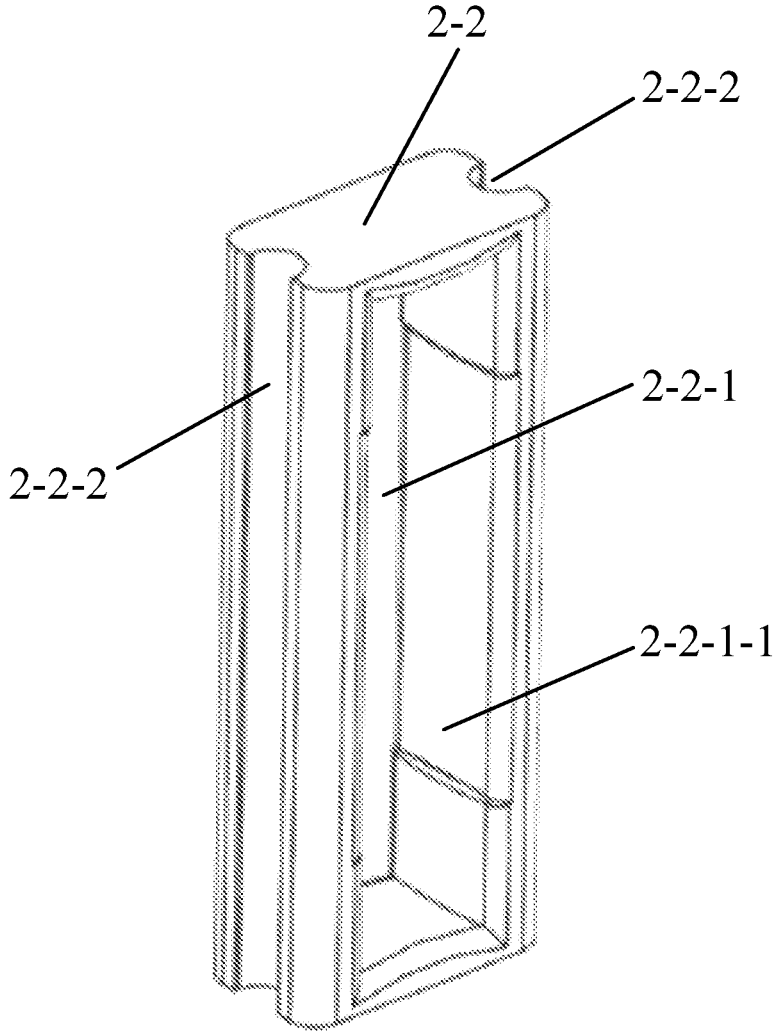
FIG. 3 shows an integrally formed second guide according to the present disclosure.

According to the above embodiments of the present disclosure, as shown in FIGS. 2 and 3, the first guide 2-1 has a first guiding through hole 2-1-1. The second guide 2-2 has a second guiding through hole 2-2-1.

The movable contact holder 4 passes through the first guiding through hole 2-1-1 and the second guiding through hole 2-2-1.

When the movable contact holder 4 reciprocates between the open position and the closed position, the outer peripheral surface of the movable contact holder 4 is in frictional contact with a first inner peripheral surface 2-1-1-1 of the first guiding through hole 2-1-1 and a second inner peripheral surface 2-2-1-1 of the second guiding through hole 2-2-1, respectively.

According to the above embodiments of the present disclosure, the movable contact holder 4 is provided with a movable contact holding through hole 4-1.

A holding spring 6 is accommodated in the movable contact holding through hole 4-1.

One end of the holding spring 6 abuts against an inner surface 4-1-1 of the movable contact holding through hole 4-1.

The other end of the holding spring 6 elastically presses the movable contact 5 against the inner surface 4-1-1 of the movable contact holding through hole 4-1.

Since the friction between the movable contact holder 4 and the first guide 2-1 as well as the second guide 2-2 is the friction between thermosetting plastic materials, the self-lubricating function of thermoplastic plastic materials can be fully exerted, thus significantly reducing the friction between the movable contact holder 4 and the first guide 2-1 and the second guide 2-2, and further significantly reducing the generation of pollution particles.

According to the above configurations of the present disclosure, motion performance of the moving contact is greatly improved and the risk of mismatch (gap) between the silver tips between the moving contact and the fixed contact due to long-term friction is avoided.

According to the above embodiments of the present disclosure, as shown in FIG. 2, a enhancing rib 2-1-2 is provided on the outer peripheral surface of the first guide 2-1, thereby enhancing the mechanical strength and durability of the first guide.

According to the above embodiments of the present disclosure, a fitting groove 2-2-2 is provided on the outer peripheral surface of the second guide 2-2.

As shown in FIG. 1, an edge of the opening 3-1 is fitted in the fitting groove 2-2-2.

According to the above embodiments of the present disclosure, as shown in FIGS. 2 and 3, the first guide 2-1 is an integrally formed single piece. The second guide 2-2 is an integrally formed single piece.

The movable contact holder 4 is first assembled with the first guide 2-1 and the second guide 2-2, and then assembled in the casing unit 3.

Figure 4:
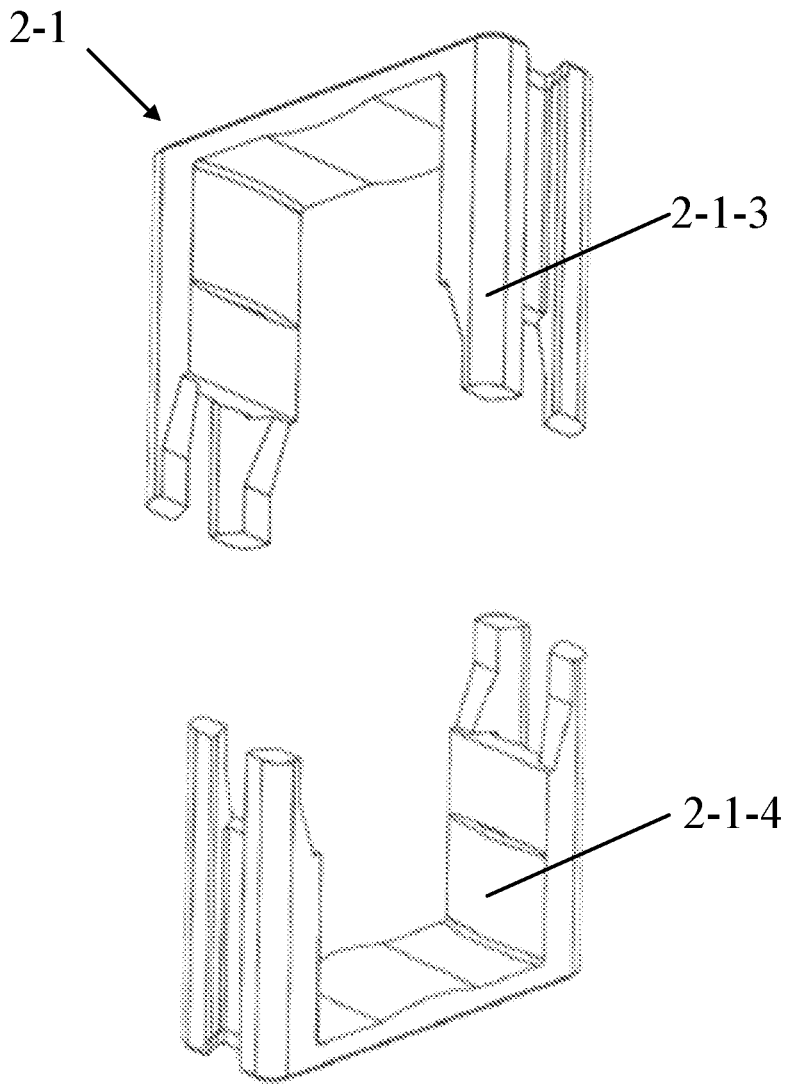
FIG. 4 illustrates a first guide formed separately according to the present disclosure.
Figure 5:
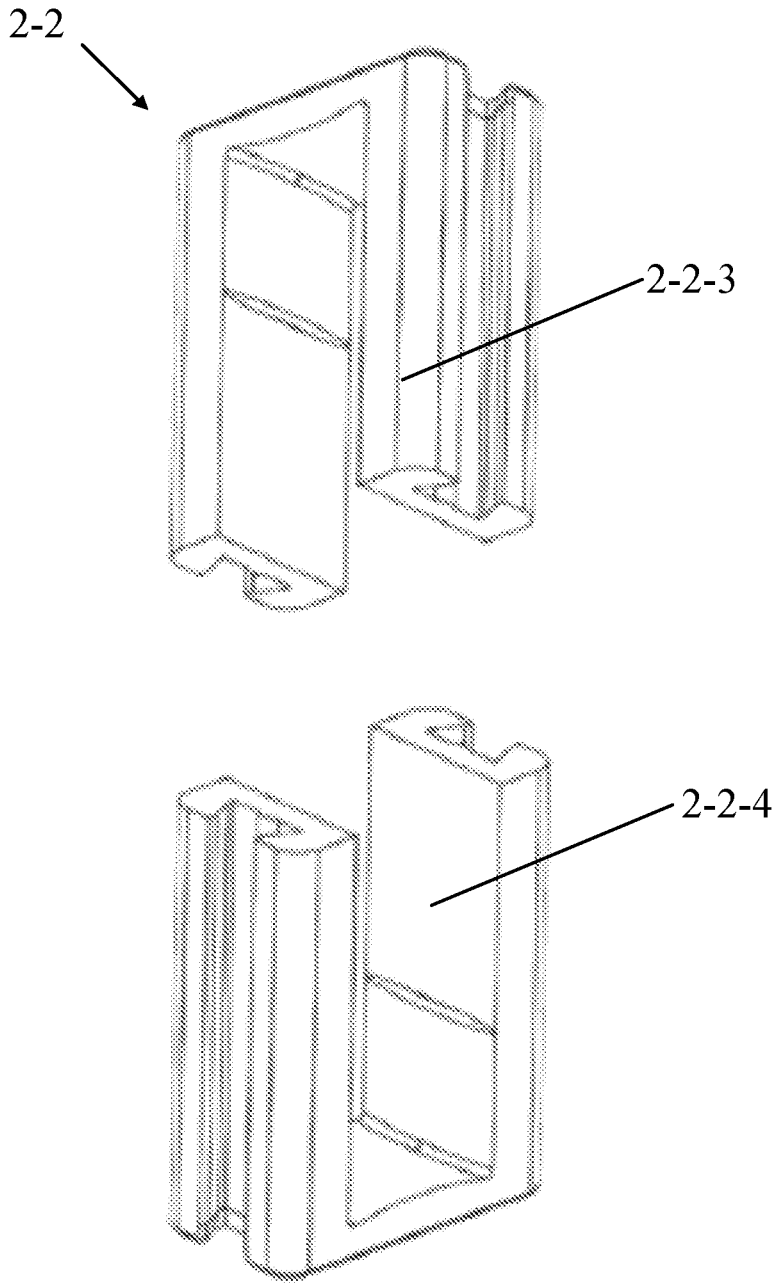
FIG. 5 shows a second guide formed separately according to the present disclosure.

According to some embodiments of the present disclosure, as shown in FIGS. 4 and 5, the first guide 2-1 includes a first upper guide 2-1-3 and a first lower guide 2-1-4 which are formed separately.

The second guide 2-2 includes a second upper guide 2-2-3 and a second lower guide 2-2-4 formed separately.

The first guiding through hole 2-1-1 is formed when the first upper guide 2-1-3 and the first lower guide 2-1-4 are assembled together.

The second guiding through hole 2-2-1 is formed when the second upper guide 2-2-3 and the second lower guide 2-2-4 are assembled together.

According to the above embodiments of the present disclosure, the casing unit 3 includes an upper casing (not shown) and a lower casing (as shown in FIG. 1) that can be fitted together.

The first upper guide 2-1-3 and the second upper guide 2-2-3 are integrally formed with the upper casing.

The first lower guide 2-1-4 and the second lower guide 2-2-4 are integrally formed with the lower casing.

According to the solutions disclosed by the invention, the complexity and cost of industrial assembly can be greatly simplified, whether the first guide and the second guide are integrally formed or separately formed.

According to another embodiment of the present disclosure, a contactor (not shown) is proposed, wherein the contactor comprises at least one modular breaking unit 1 as described above.

With reference to specific embodiments, although the present disclosure has been described in the specification and drawings, it should be understood that various changes can be made by those skilled in the art without departing from the scope of the disclosure as defined in the claims, and various equivalents can be substituted for various elements therein. Furthermore, the combination and collocation of technical features, elements and/or functions among specific embodiments herein are clear; nevertheless, according to these disclosures, those skilled in the art can appreciate that the technical features, elements and/or functions of an embodiment can be combined into another specific embodiment as appropriate, unless otherwise described above. In addition, according to the teaching of this disclosure, many changes can be made to adapt to special situations or materials without departing from the scope of the essence of this disclosure. Therefore, the present disclosure is not limited to the specific embodiments illustrated in the drawings and the specific embodiments described in the specification as the best modes presently contemplated for carrying out the present disclosure, but the present disclosure is intended to include all embodiments falling within the scope of the above description and the appended claims.

The invention claimed is:

1. A modular breaking unit with a holder-guiding assembly, wherein:

the modular breaking unit comprises a casing unit;

a movable contact holder for holding a movable contact of the modular breaking unit is accommodated in the casing unit;

the movable contact of the modular breaking unit is mounted on the movable contact holder;

the holder-guiding assembly is installed in the casing unit and arranged to support and guide the movable contact holder to move between an open position and a closed position;

the holder-guiding assembly is made of thermoplastic material;

the movable contact holder is made of thermosetting plastic material, the holder-guiding assembly comprises a first guide and a second guide, the first guide is disposed inside the casing unit and supports one end of the movable contact holder, the second guide is disposed at an opening of the casing unit and supports the other end of the movable contact holder, the first guide and the second guide are sequentially arranged in a movement direction of the moveable contact holder.

2. The modular breaking unit according to claim 1, wherein:

the first guide has a first guiding through hole;

the second guide has a second guiding through hole;

the movable contact holder passes through the first guiding through hole and the second guiding through hole;

when the movable contact holder reciprocates between the open position and the closed position, an outer peripheral surface of the movable contact holder is in frictional contact with a first inner peripheral surface of the first guiding through hole and a second inner peripheral surface of the second guiding through hole, respectively.

3. The modular breaking unit according to claim 1, wherein:

the movable contact holder is provided with a movable contact holding through hole;

a holding spring is accommodated in the movable contact holding through hole;

one end of the holding spring abuts against an inner surface of the movable contact holding through hole;

the other end of the holding spring elastically presses the movable contact against the inner surface of the movable contact holding through hole.

4. The modular breaking unit according to claim 2, wherein:

an enhancing rib is provided on the outer peripheral surface of the first guide.

5. The modular breaking unit according to claim 4, wherein:

a second guide fitting groove is arranged on the outer peripheral surface of the second guide;

an edge of the opening of the casing is fitted in the fitting groove.

6. The modular breaking unit according to claim 2, wherein:

the first guide is an integrally formed single piece;

the second guide is an integrally formed single piece;

the movable contact holder is first assembled with the first guide and the second guide, and then assembled in the casing unit.

7. The modular breaking unit according to claim 2, wherein:

the first guide includes a second upper guide and a second lower guide formed separately;

the second guide includes a second upper guide and a second lower guide formed separately;

the first guiding through hole is formed when the first upper guide and the first lower guide are assembled together;

the second guiding through hole is formed when the second upper guide and the second lower guide are assembled together.

8. The modular breaking unit according to claim 7, wherein:

the casing unit includes an upper casing and a lower casing which can be fitted together;

the first upper guide and the second upper guide are integrally formed with the upper housing;

the first lower guide and the second lower guide are integrally formed with the lower casing.

9. A contactor, wherein the contactor comprises at least one modular breaking unit according to claim 1.

* * * * *